US006213805B1

(12) United States Patent
Jedlitschka et al.

(10) Patent No.: US 6,213,805 B1
(45) Date of Patent: Apr. 10, 2001

(54) BOOT/RING FOR HIGH VOLTAGE CONNECTOR AND HIGH-VOLTAGE CONNECTOR OBTAINED

(76) Inventors: Hans Jedlitschka, 110, rue Pierre Brossolette, 92320 Chatillon; Jacques Siruel, 20, rue Chateaubriand, 91320 Wissous, both of (FR)

( * ) Notice: Subject to any disclaimer, the term of this patent is extended or adjusted under 35 U.S.C. 154(b) by 0 days.

(21) Appl. No.: 09/168,696

(22) Filed: Oct. 8, 1998

(30) Foreign Application Priority Data

Oct. 9, 1997 (FR) ..... 97 12609

(51) Int. Cl.[7] ..... H01R 13/52

(52) U.S. Cl. ..... 439/271; 277/606

(58) Field of Search ..... 439/272, 271, 439/519; 277/910, 606, 935, 936

(56) References Cited

U.S. PATENT DOCUMENTS

| | | | | |
|---|---|---|---|---|
| 4,327,924 | * | 5/1982 | Wheeler | 277/551 |
| 4,335,928 | | 6/1982 | Barrett et al. | 439/519 |
| 4,361,721 | * | 11/1982 | Massey | 277/615 |
| 4,903,972 | * | 2/1990 | Ombredane | 277/606 |
| 5,075,174 | * | 12/1991 | Pyle | 277/652 |
| 5,358,419 | | 10/1994 | Pejsa et al. | 439/201 |
| 5,586,776 | * | 12/1996 | Kubouchi et al. | 277/595 |
| 5,596,621 | | 1/1997 | Schwarz et al. | 378/130 |

* cited by examiner

*Primary Examiner*—Paula Bradley
*Assistant Examiner*—Tho D. Ta
(74) *Attorney, Agent, or Firm*—Jay L. Chaskin

(57) ABSTRACT

A boot/ring comprising an annular core made of a closed-cell elastomer foam entirely coated with elastomer foam entirely coated with an elastomer covering that can withstand the electric insulating and cooling liquid contained in connector, at the connector operating temperature. Application: to high-voltage connectors for X-ray apparatuses.

16 Claims, 2 Drawing Sheets

BOOT/RING FOR HIGH VOLTAGE CONNECTOR AND HIGH-VOLTAGE CONNECTOR OBTAINED

BACKGROUND OF THE INVENTION

The present invention relates in general to a high-voltage (HT) connector, particularly for providing power to X-ray tubes.

The HT current source for powering an X-ray tube is conventionally encased in a box filled with an insulating and cooling medium, generally a mineral oil, while the X-ray tube is itself also encased in another box filled with an insulating and cooling medium, for example a mineral oil.

Depending on the type of HT current source and the type of X-ray tube, whether it is monopole or symmetric, one or more HT cables convey HT current from the source to the X-ray tube. These power leads are connected to the HT source and to the X-ray tube by means of hermetically sealed HT connectors.

These HT connectors generally consist of two parts, a female part or receptacle which is attached permanently to the box and a male part or plug intended to plug into the receptacle to produce electrical continuity and which constitutes the end of the HT cable.

To withstand the high voltages of the source and of the X-ray tube, which may be as much as 150 kV or more, the receptacle and the plug of the HT connector are made of an insulating material and have shapes and sizes which are generally dictated by international standards.

To protect the users, the boxes of the HT source and of the X-ray tube are earthed and an external jacket of the HT cable is also earthed by metal parts of the receptacle and of the plug.

The HT source and the X-ray tube are electrically connected to the HT cable by interacting metal contacts arranged in receptacle of the connectors.

To avoid electrical discharge between the contacts and the metal parts of the connector of the HT source or of the X-ray tube, the gap between the receptacle and the plug is filled with an electrically insulating fluid, for example a mineral oil or grease such as a silicon oil or grease.

To keep this insulating fluid in the gap between the receptacle and the plug, an annular seal is arranged between the open end of the receptacle and a flange of the plug. As the volume of insulating fluid varies with temperature, and in fact increases as the temperature rises, it is necessary, in order to avoid excessively high pressures which could lead to leaks of insulating fluid and even to the destruction of the receptacle with a risk of HT electrical discharge, that this increase in volume of the insulating fluid be compensated.

To compensate for such variations in volume of the insulating fluid, use is made of a boot/ring, the volume of which varies as a function of the pressure of the insulating fluid in order to accommodate the increase in volume of the insulating fluid.

Furthermore, this annular seal needs to operate over a wide temperature range and be chemically able to resist the hot insulating fluid.

A first boot/ring conventionally used is depicted in FIG. 2. This ring 41 is a ring made of metal which has a accordion side wall 42. This ring is easy to handle and reliable in the long term but is very expensive to manufacture.

Another boot/ring also used is depicted in FIG. 3. This composite ring 43 is composed of a flat metal annulus 44 to which an elastomer annulus 45 is attached, forming a half torus inside the metal annulus 44. This boot/ring is difficult to handle, and requires extremely accurate fitting means to avoid leaks and is expensive.

BRIEF SUMMARY OF THE INVENTION

The purpose of the present invention is therefore to provide a boot/ring for a high-voltage connector which overcomes the drawbacks of the boot/rings of the prior art, and in particular which is reliable, easy to manufacture and inexpensive.

Also, the subject of the present invention is an HT connector comprising a boot/ring of this kind.

An embodiment of the invention is a boot/ring for an HT connector which is composed of an annular core made of a closed-cell elastomer foam entirely coated with a covering made of an elastomer that can withstand the insulating and cooling liquid at the HT connector operating temperature.

For the core of the boot/ring according to the invention, use may be made of any closed-cell elastomer foam, for example, a polyurethane or neoprene foam.

Given that the usual elastomer foams do not have the desired resistance to the insulating and cooling liquid (for example an oil) present in the HT connector, particularly when hot, the elastomer foam is entirely coated with a covering made of elastomer that can resist the insulating and cooling liquid at the HT connector operating temperature.

For the covering, use may be made of any elastomer which satisfies the above requirement. Among the elastomers that can be used, mention may be made of olefin elastomers such as neoprene, elastomeric polyesters, silicone elastomers, halogenated-olefin elastomers, particularly chlorinated olefin elastomers, and polyurethane elastomers.

DETAILED DESCRIPTION OF THE INVENTION

Figure 1:
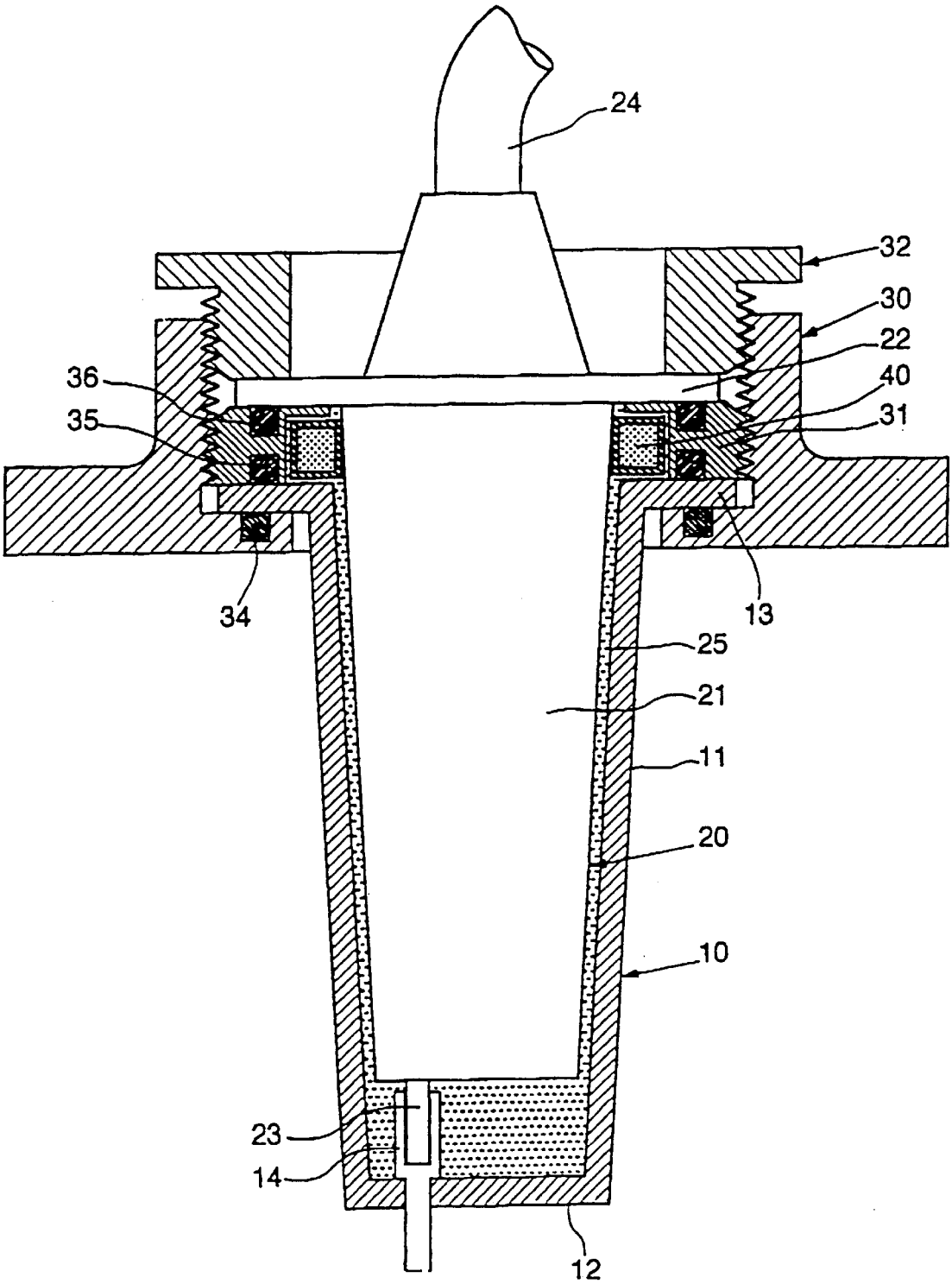
FIG. 1 is a sectional view of an HT connector including a boot/ring.
Figure 2:
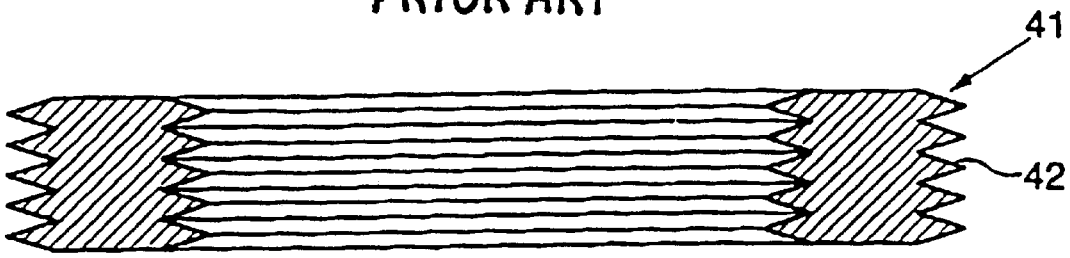
FIG.2 PRIOR ART
FIG. 2 is a sectional view of a boot/ring of the prior art.
Figure 3:
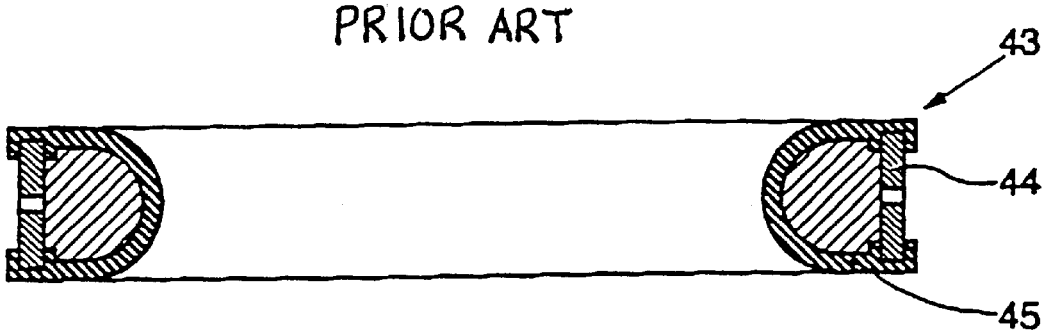
FIG.3 PRIOR ART
FIG. 3 is a sectional view of another boot/ring of the prior art.

FIG. 1 depicts an HT connector into which a boot/ring can be incorporated.

The HT connector in FIG. 1 comprises a female part or receptacle 10 and a male part or plug 20.

The receptacle 10 is fixed to the box 30 of an HT device such as an HT power supply source or of an X-ray tube. This receptacle 10 comprises a casing which is generally insulating, of frustoconical shape, with a side wall 11, an end wall 12, and an open end with a coupling flange 13.

An electrical contact 14, for example a female contact, is arranged inside the receptacle 10 on the end wall 12.

The plug 20 of the connector, electrically connected to an HT cable 24, comprises a body 21 made of an electrically insulating material with a frustoconical shape that complements that of the receptacle 10 and an annular flange 22, generally made of metal, where the insulating body 21 meets the HT cable 24.

The front face of the insulating body 21 has an electrical contact 23, for example a male contact, connected to the conductor of the HT cable 24 and interacting with the contact 14 of the receptacle 10 to produce electrical continuity between the HT power supply or the X-ray tube and the HT cable 24 when the plug 20 is plugged in to the receptacle 10.

As depicted in FIG. 1, the receptacle 10 is held on the metal box 30 via the flange 13 by means of an intermediate threaded annular nut 31 interacting with a complementary threaded vertical wall of the box 30.

Between the flange 13 of the receptacle 10 and an annular rim of the intermediate ring 31 there is a boot/ring 40 according to an embodiment of the invention.

The plug 20 of the connector is held in the receptacle 10 by the compressive force exerted by a threaded annular nut 32 interacting with the threaded vertical wall of the box 30, on the annular flange 22 so as to press the latter against the intermediate nut 31.

The box 30, the intermediate nut 31 and the nut 32 which are made of electrically conductive material, ensure earth continuity of the screening of the HT cable 24 to the box.

Conventional O-ring seals 34, 35, 36 are generally arranged between the box 30 and the flange 13 of the receptacle 10 and between the intermediate nut and the flanges 13 and 22 of the receptacle 10 and of the plug 20.

The space between the insulating body 21 of the plug 20 and the internal surface of the receptacle 10 is filled with an electrically insulating and cooling liquid 25, for example an oil.

When the HT connector is in operation, the increase in temperature of the insulating and cooling liquid increases the pressure exerted by the liquid. The boot/ring 40 according to the invention makes it possible to maintain sealing between the receptacle 10 and the plug 20 of the connector by accommodating the increase in pressure of the insulating liquid.

Figure 4:
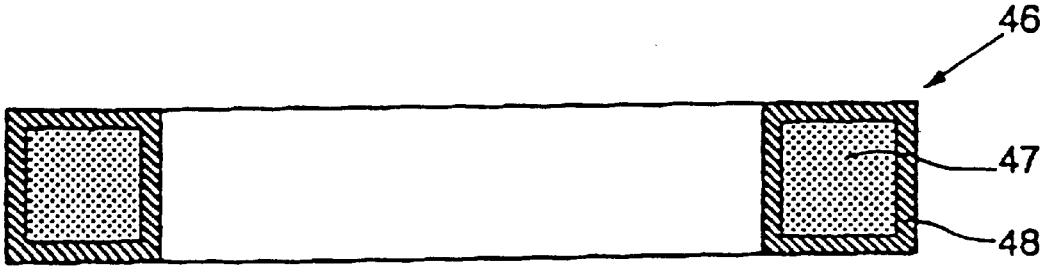
FIG. 4 is a sectional view of an embodiment of a boot/ring of the present invention.

As shown in FIG. 4, the boot/ring 46 according to an embodiment of the invention comprises an annular core 47 made of a closed-cell elastomer foam which is completely coated with a covering 48 made of an elastomer that can resist the insulating and cooling liquid at the connector operating temperature.

Because of the presence of the closed-cell elastomer foam core 46, the boot/ring has enough elasticity to compensate for the increases in volume of the insulating liquid. The elastomer covering 48 gives the boot/ring the ability to resist the corrosive action of the hot insulating liquid, as conventional elastomer foams do not have sufficient resistance.

Various modifications in structure and/or function and/or steps may be made by one skilled in the art to the disclosed embodiments without departing from the scope and extent of the invention.

What is claimed is:

1. A high-voltage connector comprising a receptacle, a plug that complements the receptacle and plugs into the receptacle to produce electric continuity and a boot/ring comprising an annular core made of a closed-cell elastomer foam entirely coated with an elastomer covering that can withstand the electric insulating and cooling liquid used inside the connector, at the connector operating temperature arranged between the receptacle and the plug to maintain a seal between the plug and the receptacle to accommodate the increase in volume of the insulating fluid without substantial movement of the boot/ring with respect to the plug and/or the receptacle.

2. The high-voltage connector according to claim 1, in which the boot/ring is arranged between a flange of the plug and a flange of the receptacle.

3. Boot/ring according to claim 1 wherein the annular core is made of polyurethane or neoprene foam.

4. The high-voltage connector according to claim 3, in which the boot/ring is arranged between a flange of the plug and a flange of the receptacle.

5. Boot/ring according to claim 1 wherein the elastomer of the covering is selected from olefin, halogenated olefin, polyester, silicone and urethane elastomers.

6. The high-voltage connector according to claim 5, in which the boot/ring is arranged between a flange of the plug and a flange of the receptacle.

7. Boot/ring according to claim 3 wherein the elastomer of the covering is selected from olefin, halogenated olefin, polyester, silicone and urethane elastomers.

8. The high-voltage connector according to claim 1, in which the boot/ring is arranged between a flange of the plug and a flange of the receptacle.

9. In combination a substantially annular plug and a substantially annular receptacle for receiving the plug within the receptacle, the plug and the receptacle being separated from each other by a substantially annular space;

a ring comprising an annular core made of a closed-cell elastomer foam entirely coated with an elastomer covering, the ring being disposed between the plug and the receptacle; and electrical insulating and cooling liquid disposed in the space between the plug and the receptacle, the liquid applying increasing pressure to the plug and the receptacle with increasing temperature when the volume of the liquid increases, the ring maintaining a seal between the plug and the receptacle to accommodate the increase in the pressure of the liquid without substantial movement of the ring with respect to the plug and/or the receptacle.

10. Boot/ring according to claim 9 wherein the elastomer of the covering is selected from olefin, halogenated olefin, polyester, silicone and urethane elastomers.

11. The combination of claim 9 comprising:

a first flange extending from the plug;

a second flange extending from the receptacle; and the ring being disposed between the first and second flanges.

12. The combination of claim 9 wherein the elastomer covering is able to withstand the corrosive action caused by the increasing temperature of the liquid.

13. Boot/ring according to claim 9 wherein the annular core is made of polyurethane or neoprene foam.

14. Boot/ring according to claim 13 wherein the elastomer of the covering is selected from olefin, halogenated olefin, polyester, silicone and urethane elastomers.

15. The combination of claim 9 comprising means for joining the plug and the receptacle in a fixed relationship as the ring maintains a seal between the plug and the receptacle to accommodate the increase in the pressure of the liquid.

16. The combination of claim 15 wherein the elastomer covering is able to withstand the corrosive action caused by the increasing temperature of the liquid.

* * * * *